US006811355B2

(12) United States Patent
Poldervaart

(10) Patent No.: US 6,811,355 B2
(45) Date of Patent: Nov. 2, 2004

(54) LOADING ARRANGEMENT FOR FLOATING PRODUCTION STORAGE AND OFFLOADING VESSEL

(75) Inventor: Leendert Poldervaart, La Turbie (FR)

(73) Assignee: Single Buoy Moorings Inc., Marly (CH)

( * ) Notice: Subject to any disclaimer, the term of this patent is extended or adjusted under 35 U.S.C. 154(b) by 0 days.

(21) Appl. No.: 10/331,632

(22) Filed: Dec. 31, 2002

(65) Prior Publication Data

US 2003/0099517 A1 May 29, 2003

Related U.S. Application Data

(62) Division of application No. 09/701,835, filed as application No. PCT/EP99/03947 on Jun. 3, 1999, now Pat. No. 6,517,290.

(30) Foreign Application Priority Data

Jun. 5, 1998 (EP) ..... 98201867

(51) Int. Cl.[7] ..... F16L 1/12; B63B 21/00

(52) U.S. Cl. ..... 405/169; 405/172; 405/224.2; 114/230.1; 114/293; 166/350

(58) Field of Search ..... 405/169, 170, 405/171, 172, 224, 224.1–224.4; 114/230.1, 230.13, 230.14, 230.15, 293, 294; 441/3–5; 166/350, 367

(56) References Cited

U.S. PATENT DOCUMENTS

| | | | | |
|---|---|---|---|---|
| 4,351,260 A | | 9/1982 | Tuson et al. | |
| 4,509,448 A | * | 4/1985 | Pease et al. | 114/293 |
| 4,546,721 A | | 10/1985 | Langrock | |
| 4,587,919 A | | 5/1986 | Loire et al. | |
| 4,604,961 A | | 8/1986 | Ortloff et al. | |
| 4,606,294 A | | 8/1986 | De Tella et al. | |
| 4,650,431 A | | 3/1987 | Kentosh | |
| 4,735,167 A | | 4/1988 | White et al. | |
| 4,784,079 A | | 11/1988 | Poldervaart | |
| 4,892,495 A | * | 1/1990 | Svensen | 441/5 |
| 5,044,297 A | | 9/1991 | de Baan et al. | |
| 5,064,329 A | | 11/1991 | Brenna | |
| 5,150,987 A | | 9/1992 | White et al. | |
| 5,275,510 A | * | 1/1994 | de Baan et al. | 405/171 |
| 5,316,509 A | | 5/1994 | Boatman et al. | |
| 5,380,229 A | | 1/1995 | Korsgaard | |
| 5,381,750 A | | 1/1995 | Pollack | |
| 5,515,803 A | * | 5/1996 | Korsgaard | 114/230.13 |
| 5,676,083 A | * | 10/1997 | Korsgaard | 114/230.1 |
| 5,678,503 A | * | 10/1997 | Poranski, Sr. | 114/230.2 |
| 5,794,700 A | | 8/1998 | Pollack | |
| 5,944,448 A | * | 8/1999 | Williams | 405/169 |
| 6,162,105 A | * | 12/2000 | Breivik | 441/4 |
| 6,244,920 B1 | | 6/2001 | de Baan | |
| 6,517,290 B1 | * | 2/2003 | Poldervaart | 114/230.1 |

FOREIGN PATENT DOCUMENTS

| | | | | |
|---|---|---|---|---|
| FR | 2 348 848 | | 11/1977 | |
| FR | 2 473 981 | | 7/1981 | |
| GB | 2 043 008 | | 10/1980 | |
| GB | 2 136 375 | | 9/1984 | |
| GB | 2180809 | * | 4/1987 | 114/293 |
| WO | 97 24257 | | 7/1997 | |

* cited by examiner

*Primary Examiner*—Jong-Suk (James) Lee
(74) *Attorney, Agent, or Firm*—Young & Thompson

(57) ABSTRACT

A loading arrangement includes a riser that extends from a subsea structure to a coupling element for coupling the riser to a vessel. The coupling element includes a buoy body which is connected to a retention member via a flexible connection part. The retention member, such as a submerged buoy, is attached to anchor lines which at or near their end parts are provided with buoy. The connection part, which can be a cable or a frame structure has a relatively high tensile strength to anchor the vessel to the sea bed and to prevent drift of the vessel when tension is exerted on the connection part and the anchor line.

10 Claims, 6 Drawing Sheets

LOADING ARRANGEMENT FOR FLOATING PRODUCTION STORAGE AND OFFLOADING VESSEL

This application is a divisional of U.S. patent application Ser. No. 09/701,835 filed Feb. 7, 2001, now U.S. Pat. No. 6,517,290, which is a 371 of PCT/EP99/03947 filed Jun. 3, 1999.

BACKGROUND OF THE INVENTION

The invention relates to a loading arrangement comprising a riser extending from a subsea structure to a coupling element that is attached to the riser for coupling the riser to a vessel, the coupling element comprising a buoy body that is connected to the sea bed via anchor lines that are provided with buoyancy means at or near their ends that are located near the buoy body.

In the Heidrun fields, oil is transferred from the subsea well to shuttle tankers via a Direct Shuttle Loading (DSL) system. In this way intermediate storage facilities need not be used and continuous oil production and transfer directly to the shuttle tanker is possible. The shuttle tankers comprise a submerged tapered loading and mooring construction having a keel cavity in which a coupling buoy is received. The tapered coupling buoy is attached to flexible risers connected to the subsea oil well and is attached to the sea bed via anchor lines. The anchor lines are near their upper ends provided with buoyancy such that the coupling buoy is maintained at a predetermined position below water level upon detaching from the shuttle tanker. Such a system is further described in WO 96/36529.

During high seas, the shuttle tanker will be disconnected from the coupling buoy, for instance at wave heights of 10 m or higher. When the wave height decreases, the shuttle tanker needs to be reattached to buoy at significant wave heights of 4–5,5 m or at higher sea states, which is a very difficult and precise operation. The horizontal and vertical position of the detached buoy, which is suspended between the buoyant upper ends of the anchor lines, is very stable and can not follow the relative movements of the vessel during the hook-up of the tapered buoy. It is therefore an object of the present invention to provide a tapered buoy loading arrangement which can be easily coupled to a shuttle tanker after detachment.

SUMMARY OF THE INVENTION

Thereto the loading arrangement according to the present invention is characterised in that the buoy body is connected to a retention member via a flexible connection part, the retention member being attached to the anchor lines, wherein the connection part has a relatively high tensile strength to anchor the vessel to the seabed and to prevent drift of the vessel when tension is exerted on the connection part and the anchor lines. By the substantially flexible connection part, the tapered buoy is decoupled from the relatively large horizontal and vertical stiffness of the anchoring means. The buoyancy means may be formed by the retention member, which may have positive buoyancy or by separate buoyancy members attached to the end of each anchor line, or by a combination thereof. It is not necessary for the buoy body to have a lot of buoyancy. Because of the substantial flexible connection of the tapered buoy to the retention member, the buoy is able to follow the vertical and horizontal movements of the vessel, which makes it easy to pull the tapered buoy in towards the shuttle tanker and to align the buoy with the keel cavity during the hook-up procedure. By providing a substantially flexible connection part, the dynamic vessel is in a flexible way connected to the relatively stiff and stable mooring and loading system formed by the retention member and the anchor lines. With the term "flexible" it is meant a connection which can be displaced in a lateral direction with respect to the vertical such as a chain or cable connection, a pivoting frame or a tubular member which comprises pivoting segments and the like.

It should be noted that an offshore tanker loading system in which a flexible attachment between a coupling member which is located at the water surface for coupling to a shuttle tanker, and a submerged retention member in the form of a buoy is known from U.S. Pat. No. 5,275,510. In the known loading system however the retention member is connected to the seabed via a riser system. From the retention member a single riser extends vertically upwards to the coupling member for providing a fluid connection with a shuttle tanker. This system can only be used in combination with a dynamical positioning system in which the tanker position is maintained constant by control of the thrusters. No anchoring forces can be transmitted through the vertical riser part towards the seabed such that an anchoring function is not present in this case.

In one embodiment of the present invention, the retention member comprises a chain table connected to the seabed via at least two anchor lines. The chain table may comprise buoyancy to keep it at its desired depth. The anchor lines can near their upper ends be provided with buoyancy members and can extend in a circular pattern around the chain table such that it is maintained at a predetermined depth below sea level, for instance 50 meters at the total water depth of for instance 1400 meters. The chain table may comprise a rotatable swivel having a stationary part connected to the riser and a rotating part connected to a flexible riser section which extends from the rotating part to the tapered buoy. The flexible riser section is attached to the tapered buoy via a second swivel for allowing displacement of the flexible riser section in a plane through the connection part. In this way relative rotations of the vessel with respect to the chain table can be accommodated without exerting too large tensions on the flexible riser section between the chain table and the tapered buoy.

In another embodiment the retention member may comprise a pivot arm that is pivotably connected to a vessel, such as a floating production storage and offloading vessel (FPSO) wherein the connection part is attached at or near the free end of the pivot arm. The pivot arm may comprise a cryogenic transfer boom having two interconnected pivoting pipes. In this system the tapered buoy is permanently connected to the pivot arm and can be easily picked up in the keel cavity of the shuttle tanker for offloading without the buoy being moored to the seabed. This embodiment is particularly useful in harsh environments and during higher sea states of wave heights between 6–8 m, and improves the shuttle tanker connect/disconnect sea state and thus the overall availability of the shuttle tanker. The distance between the first and second vessels could be as large as 500 meters. A ballast weight may be attached to the pivot arm, which in another embodiment may for instance be a delta frame, to stabilize the frame when the tapered buoy is disconnected from the shuttle tanker. A further advantage of attaching the tapered buoy to the pivot arm is that upon connection, the pivot arm keeps the shuttle tanker at a relatively fixed distance from the first vessel (FPSO).

Preferably a weight is attached to a support arm that is located transversely to the pivot arm such that the weight is located below the pivoting connection of the pivot arm when the pivot arm is in its submerged equilibrium position. In this way a stable submerged position is achieved wherein the moment on the pivot hinges is relatively low.

The connection part may comprise a chain which can be provided with a chain swivel for allowing rotation of an upper and lower chain part upon weathervaning of the vessel. It is also possible to use a substantially rigid frame member as a connection part, the frame member being connected to the buoy body via a pivot connection such that the buoy body may be tilted with respect to the frame member upon drift of the shuttle tanker.

In another embodiment the tapered buoy is connected to a first vessel via a flow line which is taken up by a winch on the vessel. The buoy could be moved into the direction of the keel cavity of the shuttle tanker via a hook up line, a remote operated vehicle (ROV) or with thrusters connected to the tapered buoy.

BRIEF DESCRIPTION OF THE DRAWINGS

Some embodiments of a loading system according to the present invention will by way of example be explained in detail with reference to the accompanying drawings. In the drawings.

DESCRIPTION OF THE PREFERRED EMBODIMENTS

Figure 1:
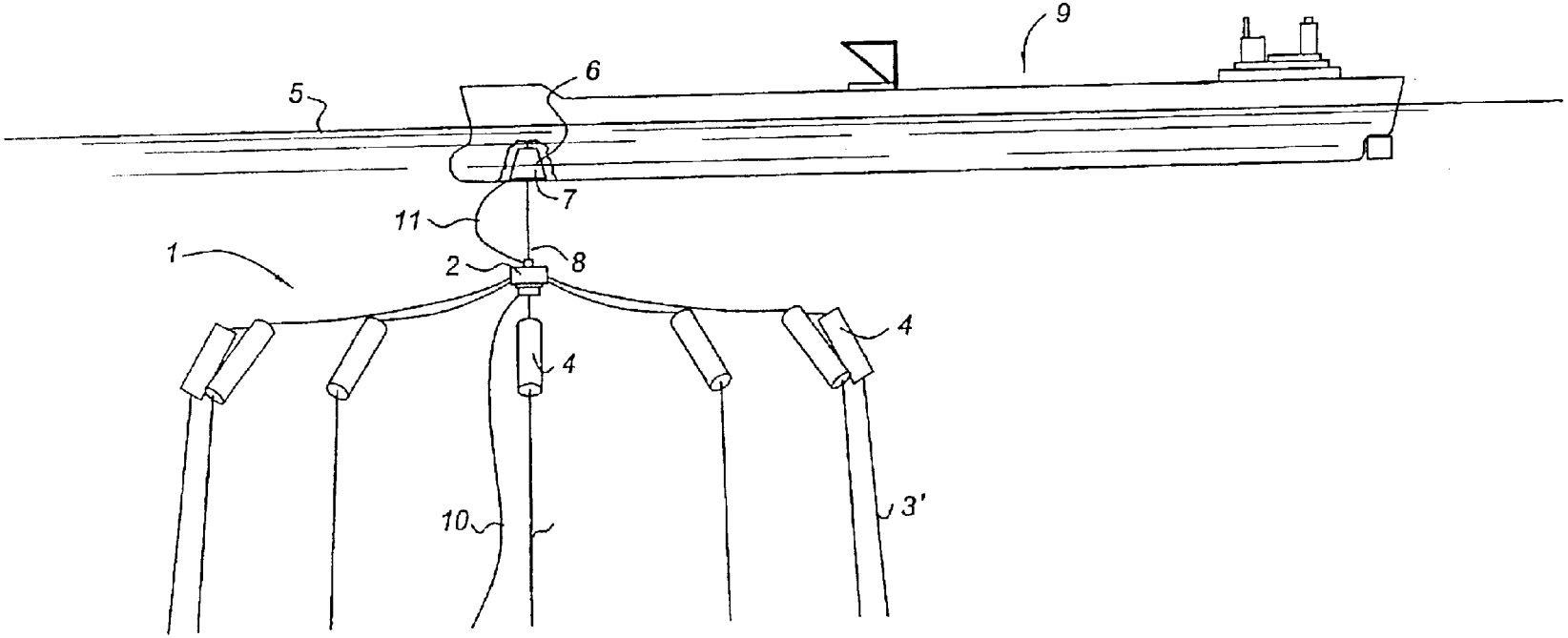
FIG. 1 shows a side view of a loading arrangement according to the present invention.

FIG. 1 shows a loading and mooring arrangement 1 according to the present invention wherein a chain table 2 is connected to a number of anchor lines 3, 3'. The anchor lines 3, 3' are connected to the seabed via anchors such as piled anchors, suction anchors or fluke anchors. At the upper ends of the anchor lines 3, 3', which can comprise anchor chains, wire rope cables or cables of synthetic materials such as polyethylene or any combination thereof, buoyancy members 4, 4' are connected. The anchor lines 3, 3' extend in a circular or grouped configuration around the chain table 2 and maintain the chain table at a predetermined position below water level 5. A tapered buoy body, or submerged turret loading buoy (STL) 7 is attached to the chain table 2 via a flexible connection part 8 which can be in the form of a chain, cable, or pivoting frame member. The tapered buoy 7 comprises coupling members for attaching to a keel cavity 6 in the shuttle tanker 9. The keel cavity 6 may be part of a turret system around which the tanker 9 can weathervane or can be fixedly placed in the hull of the vessel without the use of a turret construction.

A number of risers 10, of which only one has been shown for reasons of clarity, extend from the seabed, for instance from a subsea oil well to the chain table 2. From the chain table 2 a flexible riser section 11 extends towards the tapered buoy 7. The length of the connection part 8 may for instance be between 10 and 50 meter. The water depth in which the system is used may for instance be 1300 meter.

Figure 2:
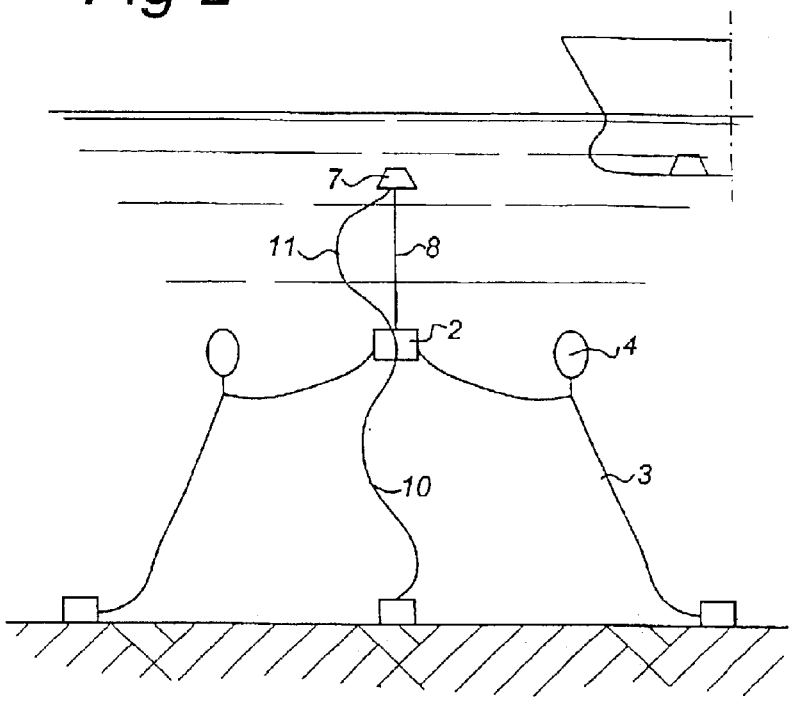
FIG. 2 shows a first embodiment of the loading arrangement wherein the connection part is formed by a cable or chain.

FIG. 2 shows an embodiment wherein the connection part 8 is formed by a chain or cable such that a large degree of freedom in positioning the tapered-buoy 7 with respect to the relatively stiffly supported chain table 2 is possible.

Figure 3:
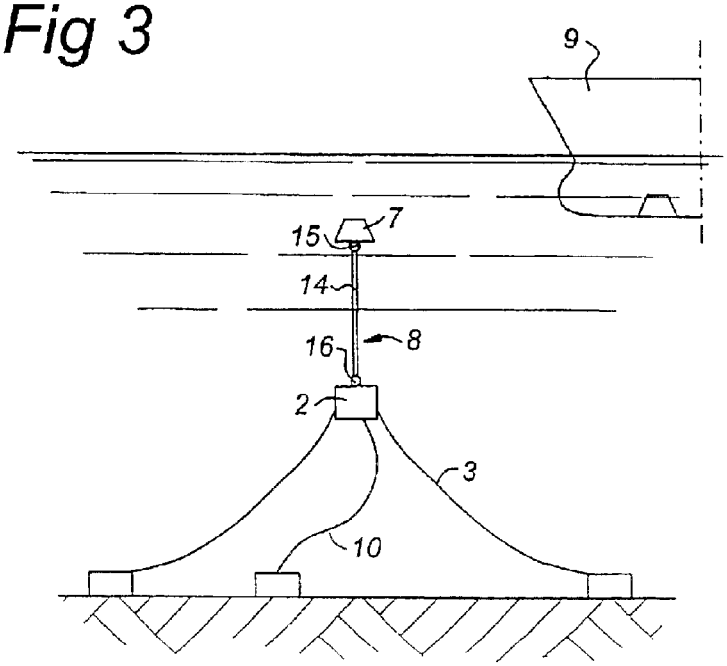
FIG. 3 shows an embodiment wherein the connection part is flexible and is formed by a substantially rigid frame member connected to the tapered buoy and to a chain table via pivot connections.

In the embodiment of FIG. 3, the connection part 8 is formed by a substantially rigid tubular member or frame member 14 which is attached to the tapered buoy 7 via a pivot joint 15. At the bottom, the tubular member or frame member 14 is connected to the chain table 2 via a pivot joint 16. However, the pivot joint 16 is optional and may be omitted. The riser 10 may be guided through the frame member 14 or could be routed outside of the frame member 14.

Figure 4:
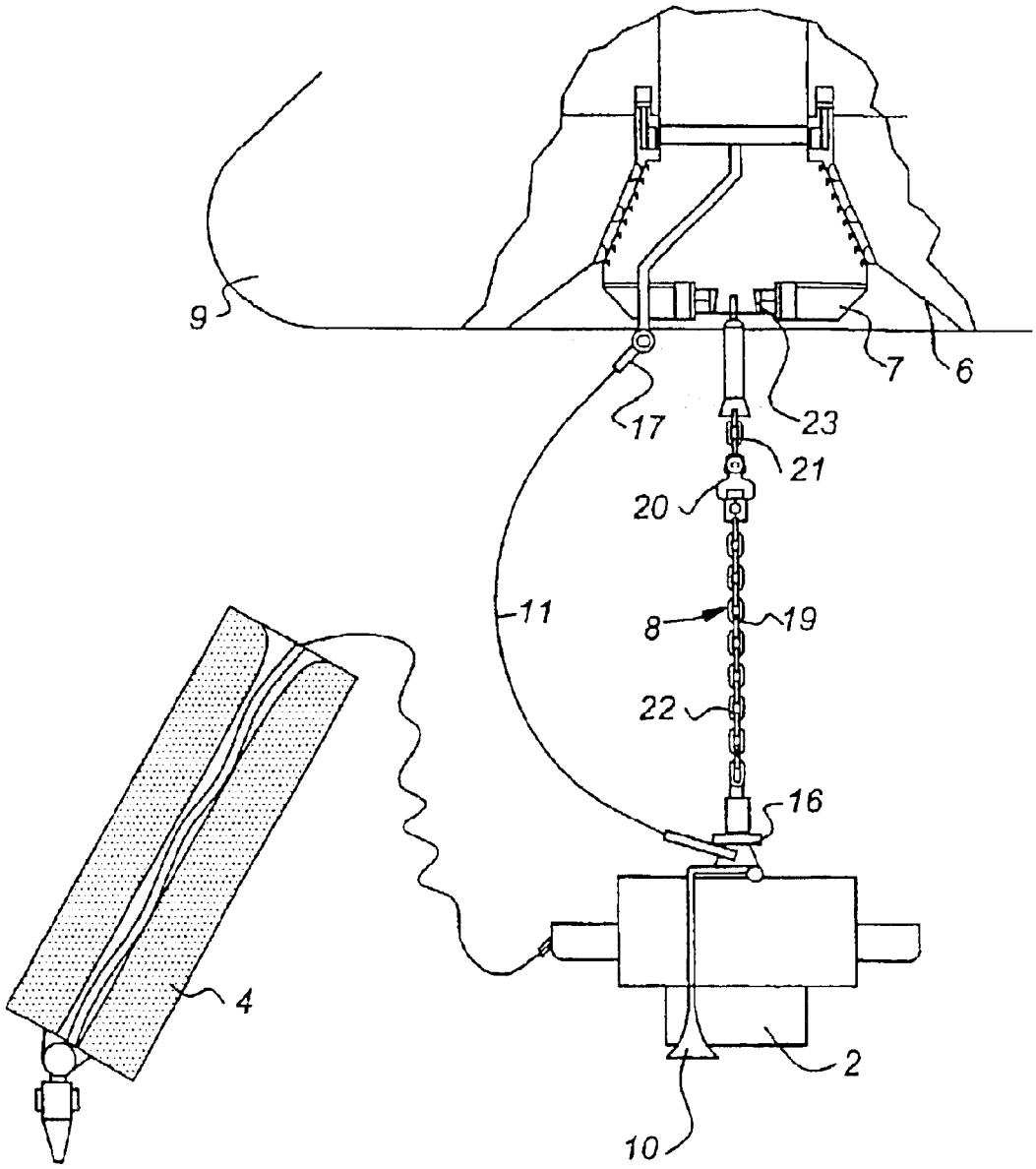
FIG. 4 shows a partially cut away enlarged detail of the loading arrangement of the present invention comprising a chain type connection part.

FIG. 4 shows an enlarged detail of the loading and mooring arrangement according to the present invention wherein the product riser 10 is connected to a stationary part of a fluid swivel 16 on the chain table 2. The rotating part of the fluid swivel 16 is connected to flexible riser section 11. At the lower end of the tapered-buoy 7, the flexible riser section 11 is connected to a swivel 17. The chain 19, connecting the chain table 2 and the buoy 7, is provided with a chain swivel 20 such that an upper chain section 21 can rotate relative to lower chain section 22 around the length dimension of the chain 19. At the upper end, the chain 21 is connected to a gimbal table 23 of the tapered-buoy 7.

Figure 5:
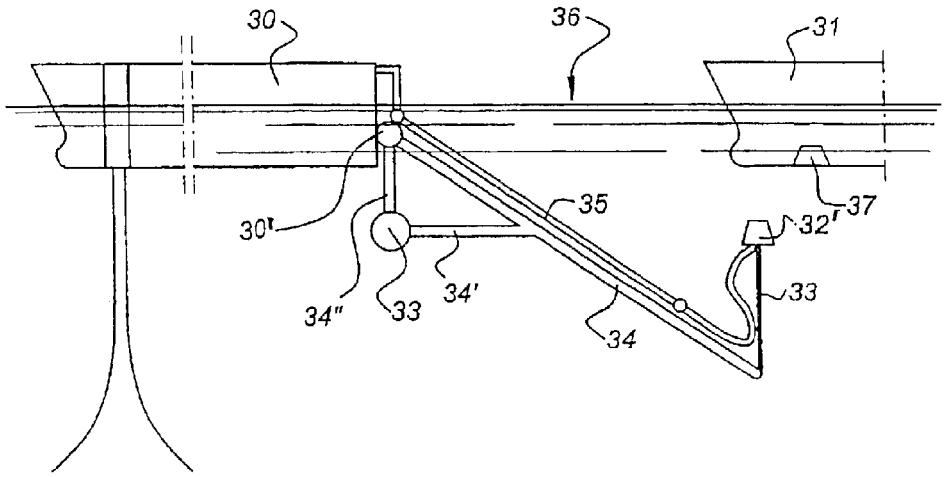
FIG. 5 shows a further embodiment of a loading arrangement of the present invention wherein the tapered buoy is connected to a pivot arm.
Figure 6:
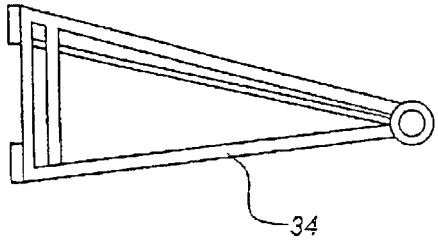
FIG. 6 shows a top view of the pivot arm of FIG. 5.

FIG. 5 shows an embodiment wherein the tapered-buoy 32 is connected via a connection part 32', which in this case may also be a cable, chain or pivoting frame member, to the end of a pivot arm 34 . The buoy 32 can be engaged with a keel cavity 37 in the shuttle tanker 31. As can be seen in figure 6, the pivot arm 34 has the form of a delta-type frame. The arm 34 is connected to a floating production storage and offloading vessel 30 via a pivot connection 30'. Transverse arms 34', 34", which extend transversely to the delta frame 34, are connected to a positioning weight 33 which in the rest position is located directly below the pivot connection 30'. A flow line 35 extends along the arm 34 to the tapered-buoy 32.

Figure 7:
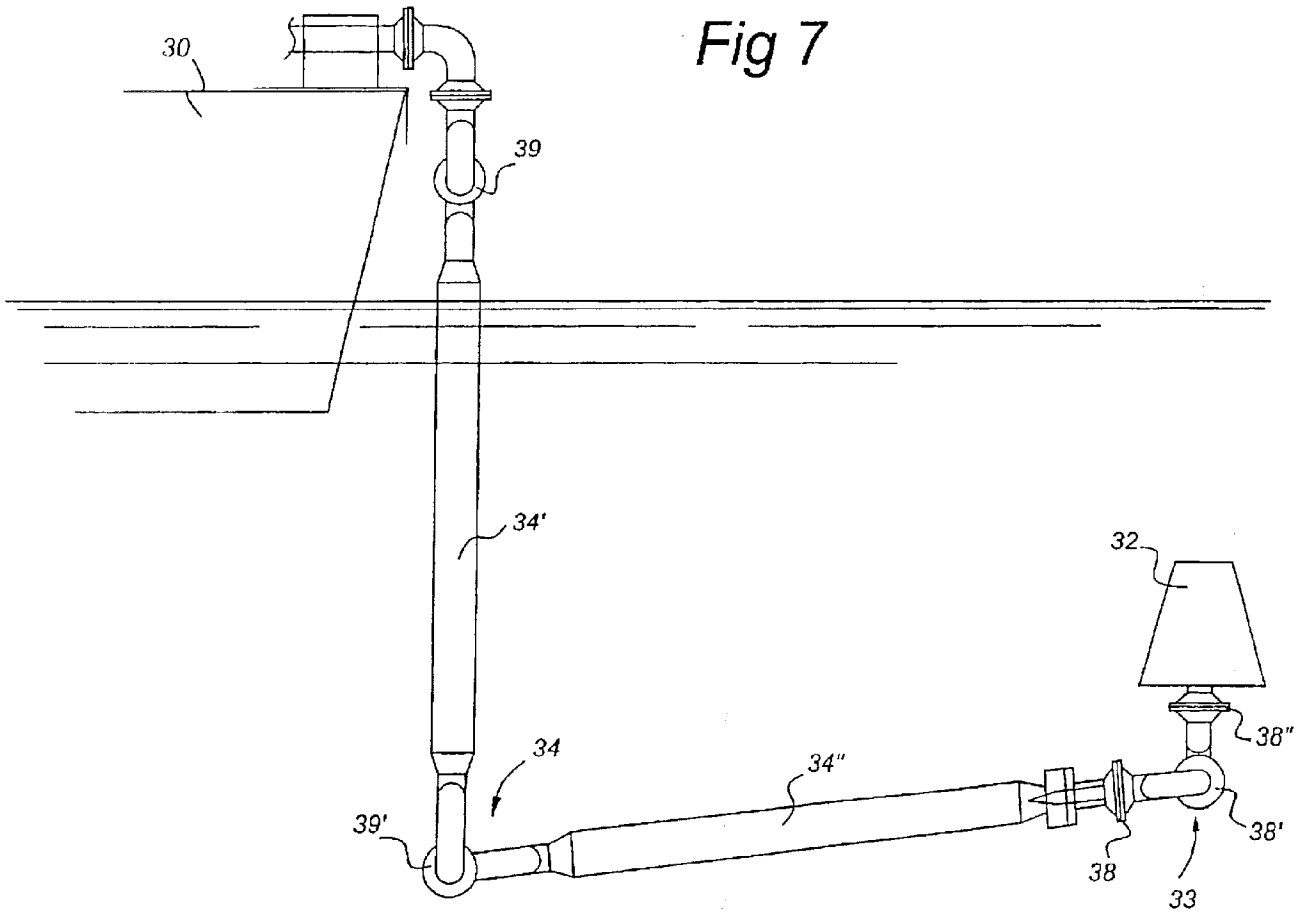
FIG. 7 shows a side view of another embodiment of a pivot arm in the form of a transfer boom.

FIG. 7 shows an embodiment wherein the pivot arm 34 is formed by a cryogenic LNG-boom having two arm sections 34', 34" which are connected in a pivot joint 39'. At the side of the vessel 30 the vertically extending arm section 34' is connected to a swivel 39. At the end of the second arm section 34", the buoy 32 is connected to a flexible member which is comprised of swivels 38, 38', 38" allowing rotational movement around an axis along the length direction of arm section 34", around an axis perpendicular to the plane of the drawing and around an axis parallel to the centre line of the buoy 32, respectively. A cryogenic LNG-boom of this type is described in detail in International patent application number PCT/EP99/01405 in the name of the applicant.

Figure 8:
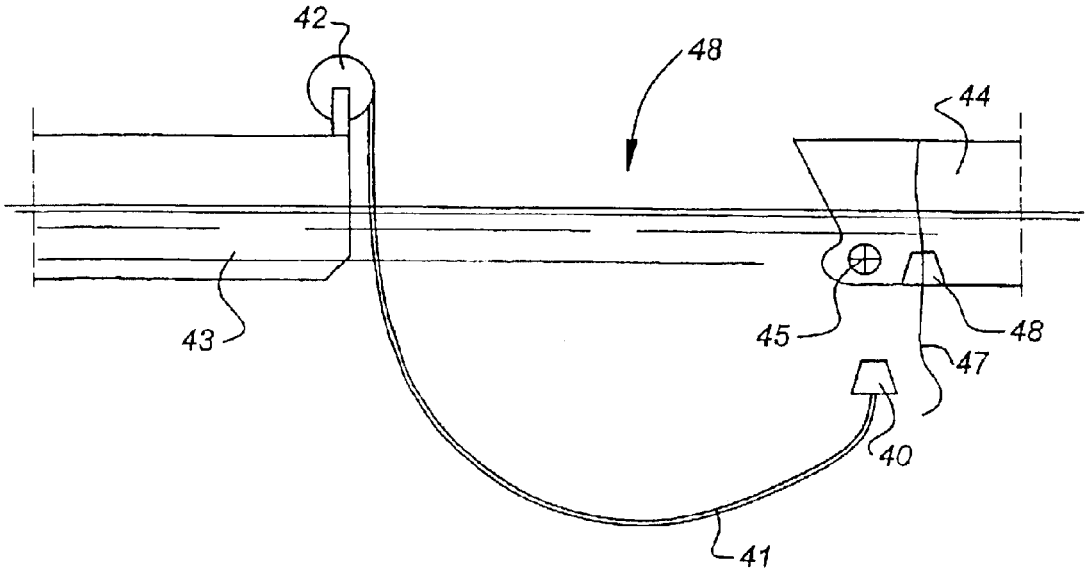
FIG. 8 shows a third embodiment wherein the tapered buoy is attached to a winch on a vessel via a flow line.

Finally, FIG. 8 shows an embodiment wherein a tapered buoy 40 is connected to a flow line 41, which has no positive buoyancy. Flow line 41 is collected on a winch 42 on the FPSO-vessel 43. A shuttle tanker 44 having a dynamic positioning system in the form of multiple thrusters 45 can be manoeuvred in the proximity of the FPSO-vessel 43 and can attach to the buoy 40 via a hook-up line 47. With the hook-up line 47 the tapered buoy 40 can be winched into the keel cavity 48 for connecting the flow line 41 to the shuttle tanker 44. No anchoring function of the flow line 41 and the buoy 40 are provided in this case, the dynamic positioning system of the shuttle tanker 44 maintaining the proper relative position of the tanker 44 with respect to the FPSO-vessel 43.

What is claimed:

1. A loading arrangement comprising:

a riser extending from a subsea structure to a coupling element that is attached to said riser for coupling said riser to a vessel, said coupling element comprising a buoy body and a retention member that is connected to said buoy body with a first flexible connection and with a second flexible connection separate from said first connection, said retention member being connected to the seabed via at least two anchor lines and being located relatively closely below sea level, wherein said first connection has a relatively high tensile strength to anchor the vessel to the seabed and to prevent drift of the vessel when tension is exerted on said first connection and said anchor lines, and wherein said retention member comprises a first swivel having a stationary part connected to said riser and a rotating part connected to said second connection.

2. The loading arrangement of claim 1, wherein said buoy body comprises a second swivel to which said second connection is attached for allowing displacement of said second connection in a plane through said first connection.

3. The loading arrangement of claim 1, wherein said anchor lines are provided with buoyant members at or near their ends that are located near said coupling element.

4. The loading arrangement of claim 3, wherein said buoyant members are attached to said anchor lines adjacent to said retention member.

5. The loading arrangement of claim 1, wherein said first connection comprises a chain.

6. The loading arrangement of claim 5, wherein said chain comprises a chain swivel having rotatable first and second segments, said first segment being attached to an upper chain section and said second segment being attached to a lower chain section for allowing relative rotation of said upper and lower chain sections around their longitudinal axis.

7. The loading arrangement of claim 1, wherein said retention member comprises a chain table.

8. A loading arrangement comprising:

a riser extending from a subsea structure to a coupling element that is attached to said riser for coupling said riser to a vessel, said coupling element comprising a buoy body and a retention member that is connected to said buoy body with a connection part, said retention member being connected to the seabed via anchor lines and located relatively closely below sea level, wherein said connection part comprises a substantially rigid member that is connected to said buoy body with a first pivot connection and that is connected to said retention member with a second pivot connection, said connection part having a relatively high tensile strength to anchor the vessel to the seabeb and to prevent drift of the vessel when tension is exerted on said connection part and said anchor lines.

9. The loading arrangement of claim 8, wherein said anchor lines are provided with buoyant members at or near their ends that are located near said coupling element.

10. The loading arrangement of claim 8, wherein said rigid member is tubular.

* * * * *